US008079918B2

(12) United States Patent
Cole et al.

(10) Patent No.: US 8,079,918 B2
(45) Date of Patent: Dec. 20, 2011

(54) GOLF CLUB HEADS WITH HOSEL WEIGHTS AND RELATED METHODS

(75) Inventors: Eric V. Cole, Phoenix, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/030,456

(22) Filed: Feb. 18, 2011

(65) Prior Publication Data

US 2011/0143860 A1 Jun. 16, 2011

Related U.S. Application Data

(63) Continuation of application No. 12/202,593, filed on Sep. 2, 2008, now Pat. No. 7,909,706.

(51) Int. Cl.
*A63B 53/04* (2006.01)

(52) U.S. Cl. ..... 473/305; 473/308; 473/324

(58) Field of Classification Search ..... 473/305, 473/307–310, 324, 334
See application file for complete search history.

(56) References Cited

U.S. PATENT DOCUMENTS

| | | | | |
|---|---|---|---|---|
| 3,680,870 | A * | 8/1972 | Burnett et al. | 473/256 |
| 5,009,423 | A * | 4/1991 | Okumoto et al. | 473/308 |
| 5,993,325 | A * | 11/1999 | Heyer | 473/256 |
| 2002/0037773 | A1 * | 3/2002 | Wood et al. | 473/246 |
| 2010/0022323 | A1 * | 1/2010 | Thomas et al. | 473/307 |
| 2010/0035701 | A1 * | 2/2010 | Kusumoto | 473/307 |

* cited by examiner

*Primary Examiner* — Stephen L. Blau

(57) ABSTRACT

Embodiments of golf club heads with hosel weights are disclosed herein. Other examples and related methods are also presented herein.

18 Claims, 4 Drawing Sheets

GOLF CLUB HEADS WITH HOSEL WEIGHTS AND RELATED METHODS

CROSS-REFERENCE TO RELATED APPLICATION

This patent application is a continuation of U.S. patent application Ser. No. 12/202,593, filed on Sep. 2, 2008. The disclosure of the referenced application is incorporated herein by reference.

TECHNICAL FIELD

This invention relates generally to golf equipment and, in particular, to a golf club head.

BACKGROUND

U.S. Pat. No. 6,206,790 to Kubica et al discloses an iron-type golf club head with a heel portion, a toe portion and a front face arranged for impact with a golf ball. In one example, golf club heads such as shown in the Kubica et al patent may be designed so that their center of gravity is directly behind or near the golf ball impact zone, which may be located at the geometric center of the front face. The moment of inertia of a golf club head can be increased by positioning more weight in the heel and toe portions of the golf club head.

DRAWINGS

DESCRIPTION

Figure 1:
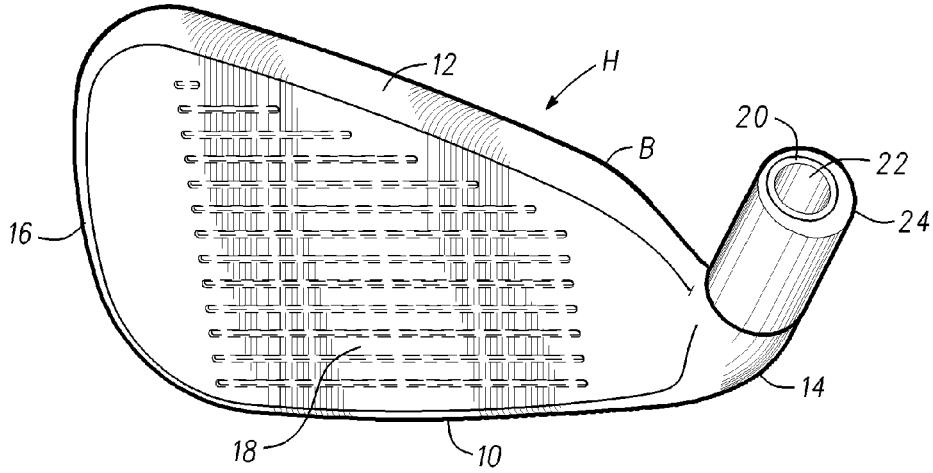
FIG. 1 is a perspective view of a golf club head incorporating one embodiment of a hosel weight according to the present invention.
Figure 2:
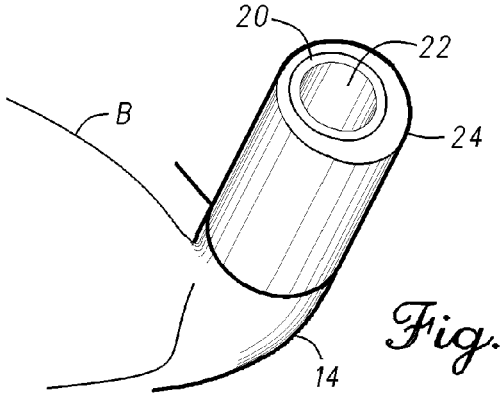
FIG. 2 is an enlarged view of a heel portion of the golf club head of FIG. 1.
Figure 3:
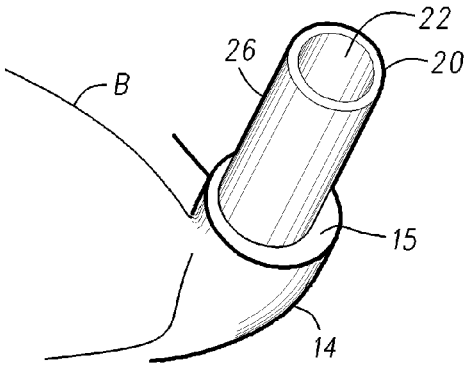
FIG. 3 is an enlarged view similar to FIG. 2 with the hosel weight removed.
Figure 4:
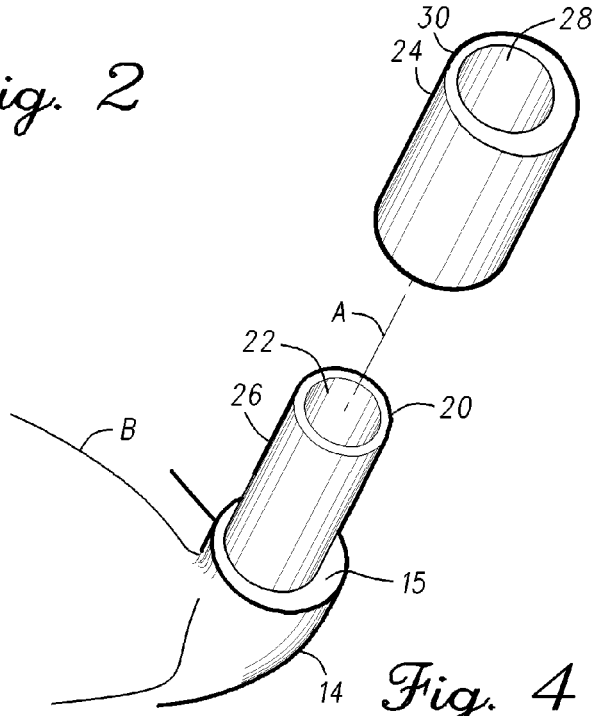
FIG. 4 is an exploded view of the heel portion of the golf club head shown in FIG. 2.

Referring to FIGS. 1-4, an iron-type golf club head H includes a body B with a sole 10, a top edge 12, a heel portion 14, a toe portion 16 and a front face 18 arranged for impacting a golf ball. Front face 18 extends between the heel and toe portions 14, 16. The golf club head H also includes a hosel 20 with a generally cylindrical shape on the heel portion 14 of the body B. The hosel 20 has a longitudinal axis A and a bore 22 defined by its peripheral wall 26 for receiving one end of a golf club shaft (not shown). The hosel bore 22 is concentric with the longitudinal axis A. The heel portion 14 of the body B includes a shoulder 15 adjacent a lower end of the hosel 20. Mounted on the hosel 20 is a hosel weight 24. The hosel weight 24 is formed as a generally cylindrical sleeve and may be fastened to the hosel 20 by conventional means such as adhesive or mechanical devices. Alternatively, the hosel 20 and the hosel weight 24 may be conical instead of cylindrical. Although FIGS. 1-4 may depict an iron-type golf club head, the apparatus and methods described herein may be applicable to other suitable types of golf club heads (e.g., driver-type golf club heads, fairway wood-type golf club heads, hybrid-type golf club heads, wedge-type golf club heads, putter-type golf club heads, etc.).

Figure 5:
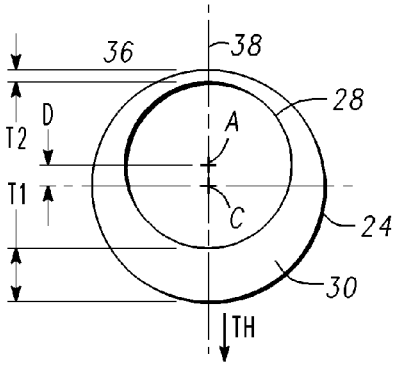
FIG. 5 is an enlarged end view of the hosel weight in one position.

Turning to FIG. 5, the hosel weight 24 has a longitudinal axis C and a generally cylindrical bore 28 which receives the hosel 20. When the hosel weight 24 is mounted on the hosel 20, its bore 28 is concentric with the longitudinal axis A and the hosel weight 24 contacts the shoulder 15. The hosel weight bore 28 is offset (i.e., not concentric) with respect to the longitudinal axis C of the hosel weight 24. Therefore, a peripheral wall 30 of the hosel weight 24 that defines the bore 28 has a varying thickness dimension. As shown in FIG. 5, the peripheral wall 30 has a thickness dimension T1 at its thickest point and a thickness dimension T2 at its thinnest point. This results in the hosel weight 24 having significantly more mass in the vicinity of the thickness dimension T1 than in the vicinity of the thickness dimension T2. As shown in FIG. 5, the hosel weight 24 may be positioned so that its longitudinal axis C is offset from the hosel longitudinal axis A by a distance D in a direction TH extending generally from the toe portion 16 toward the heel portion 14.

Figure 6:
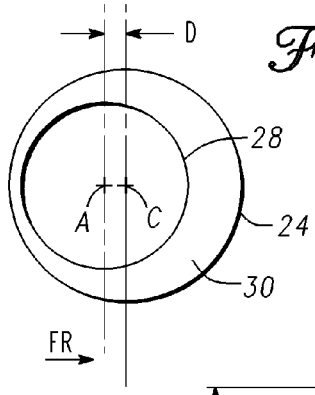
FIG. 6 is an enlarged end view of the hosel weight in another position.
Figure 7:
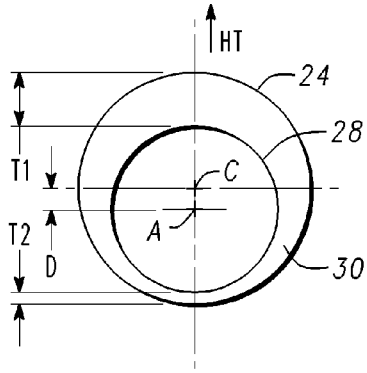
FIG. 7 is an enlarged end view of the hosel weight in a further position.
Figure 8:
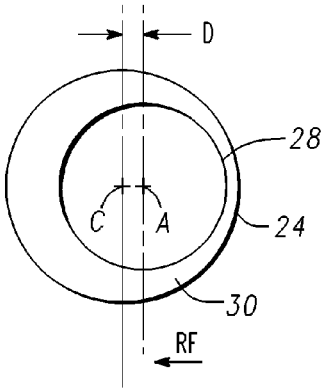
FIG. 8 is an enlarged end view of the hosel weight in another position.

Referring to FIGS. 6-8, it will be understood that the hosel weight 24 may be positioned so that its thickness dimension T1 is located at any point along the circumference of the hosel 20. For example, the hosel weight 24 may be positioned as shown in FIG. 6 so that its longitudinal axis C is offset from the hosel longitudinal axis A by the distance D in a direction FR extending generally rearwardly relative to the front face 18. The hosel weight 24 may also be positioned as shown in FIG. 7 so that its longitudinal axis C is offset from the hosel longitudinal axis A by the distance D in a direction HT extending generally from the heel portion 14 toward the toe portion 16. The hosel weight 24 may be positioned as shown in FIG. 8 so that its longitudinal axis C is offset from the hosel longitudinal axis A by the distance D in a direction RF extending generally forwardly relative to the front face 18. Therefore, the hosel weight 24 may be positioned with its thickness dimension T1 located on the forward side, the rearward side, the toe side or the heel side of the hosel 20 or anywhere in between those positions. As described in detail below, the position of the thickness dimension T1 may affect the center of gravity and/or the moment of inertia of the club head H.

In one embodiment, the body B including the hosel 20 is made of a metallic material such as steel having a first density while the hosel weight 24 is made of a metallic material such as tungsten having a second density which is greater than the first density. Alternatively, in other embodiments, the body B including the hosel 20 is made of titanium and the hosel weight 24 is made of either zirconium or tungsten. In further embodiments, the body B including the hosel 20 is made of composite material and the hosel weight 24 is made of either metal or another composite material. It is preferred, but not required, that the material (i.e. tungsten or zirconium) forming the hosel weight 24 will have a higher density than the material (i.e. steel or titanium) forming the body B including the hosel 20.

The hosel weight 24 adds mass to the hosel 20 which increases the moment of inertia of the club head H. The amount of mass added to the hosel 20 is significantly increased and the moment of inertia of the club head H is significantly increased when the hosel weight 24 is made of denser material as described above than the body B. With the hosel weight 24 mounted on the hosel 20, the center of gravity of the club head H is shifted toward the heel portion 14 of the body B. When comparing the positions of the hosel weight 24 as shown in FIGS. 5 and 7, it will be realized that the club head center of gravity will be shifted farther toward the body heel portion 14 and the club head moment of inertia will be increased more with the hosel weight 24 in the position shown in FIG. 5 than with the hosel weight 24 in the position shown in FIG. 7. Depending on the particular orientation of the hosel weight 24 on the hosel 20, the center of gravity of the club head H may also be shifted slightly forward or rearward. For example, when the hosel weight 24 is in the orientation shown in FIG. 6, the club head center of gravity is shifted slightly rearward and, when the hosel weight 24 is in the orientation shown in FIG. 8, the club head center of gravity is shifted slightly forward.

If a golfer desires the club head H to have its center of gravity shifted as far toward the heel portion 14 as possible in addition to having its moment of inertia maximized, the hosel weight 24 should be in the position shown in FIG. 5. If a golfer desires the club head H to have its center of gravity shifted as far rearward as possible, the hosel weight 24 should be in the position shown in FIG. 6 and, if a golfer desires the club head H to have its center of gravity shifted as far forward as possible, the hosel weight 24 should be in the position shown in FIG. 8. An optimal position for the hosel weight 24 may be when it is rotated approximately 45 degrees counterclockwise from the position shown in FIG. 5 so that its thickness dimension T1 is located halfway between the positions shown in FIGS. 5 and 6.

While the above examples may describe and depict the hosel weight 24 being mounted on the body B in a particular manner (e.g., FIG. 2), the club head H may be manufactured so that both the shoulder 15 and the hosel weight 24 vary in thickness dimension. In another example, the hosel 20 and the hosel weight 24 may be concentric and thus share a common longitudinal axis (e.g., the hosel longitudinal axis A). In a further example, the shoulder 15 may vary in thickness dimension while the hosel weight 24 may have a substantially uniform thickness dimension. In this example, the shoulder 15 may vary in thickness dimension in a similar manner as shown in FIGS. 5, 6, 7, and/or 8. Referring to FIGS. 5-8, for example, the shoulder 15 may have a first thickness dimension T1 and a second thickness dimension T2.

Figure 9:
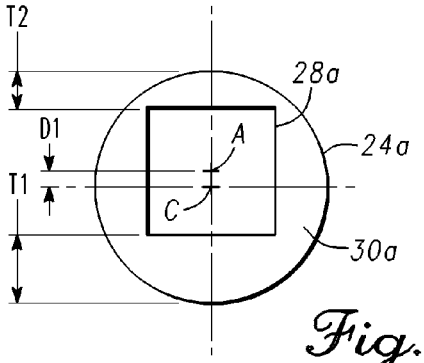
FIGS. 9-11 are enlarged end views similar to FIG. 5 showing different embodiments of the hosel weight.
Figure 10:
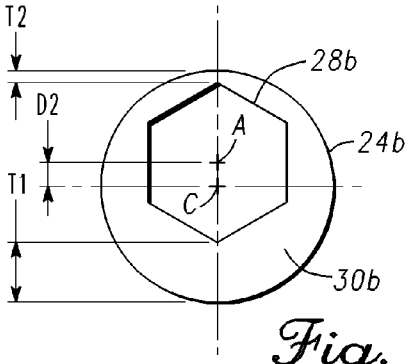
Figure 11:
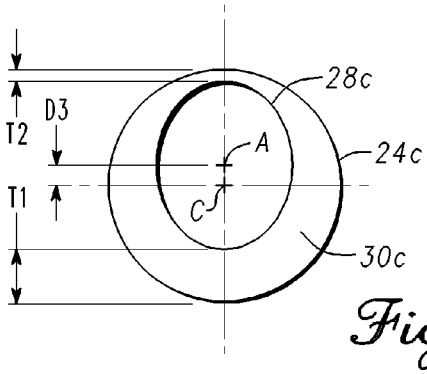
Figure 12:
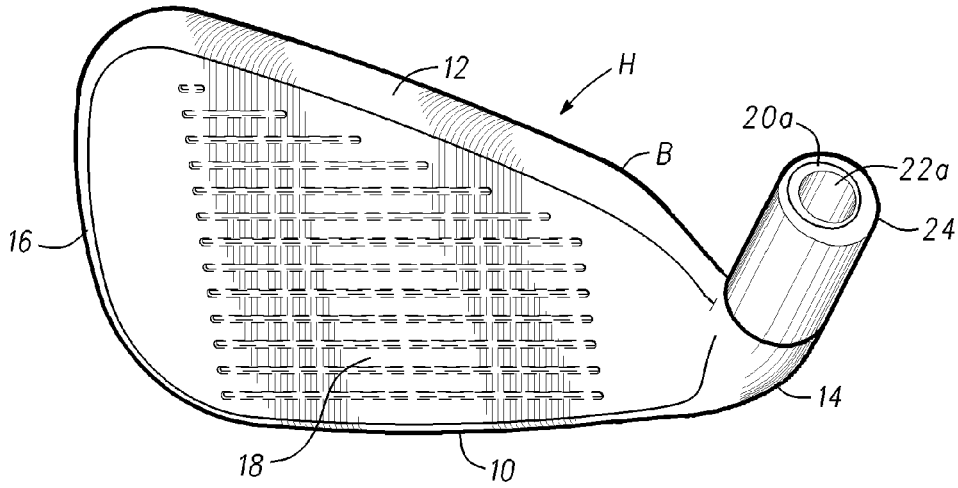
FIGS. 12-15 are views similar to FIGS. 1-4 showing the hosel weight mounted on an alternative golf club head.
Figure 13:
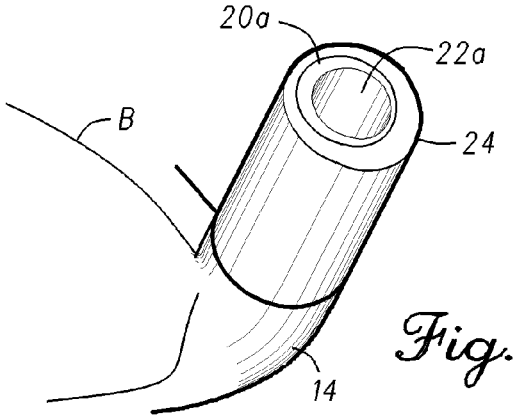
Figure 14:
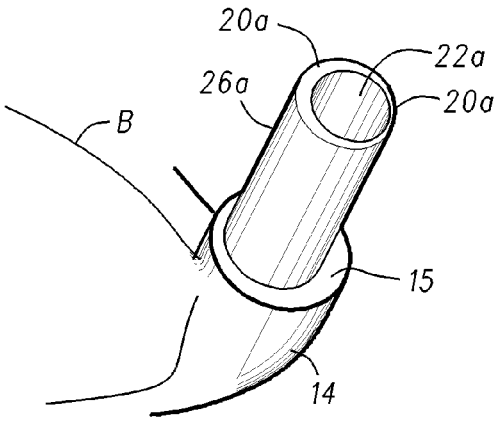
Figure 15:
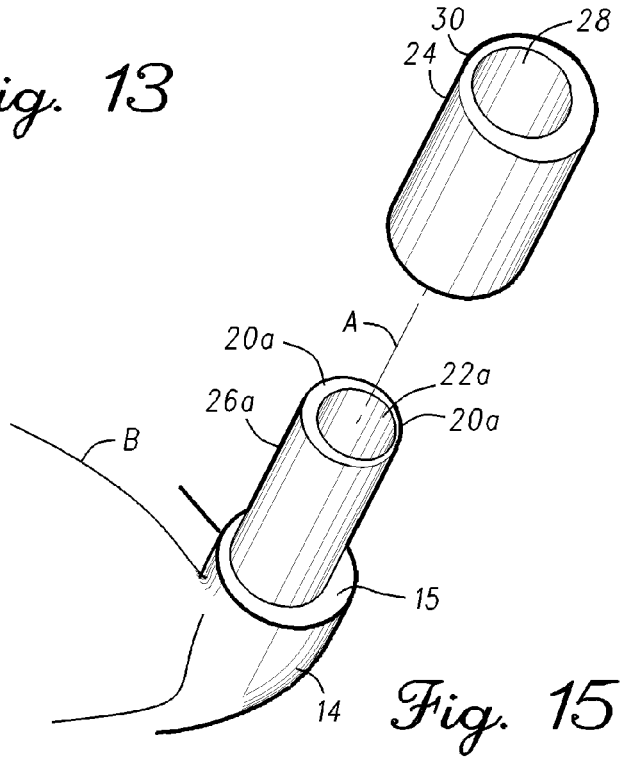
Figure 16:
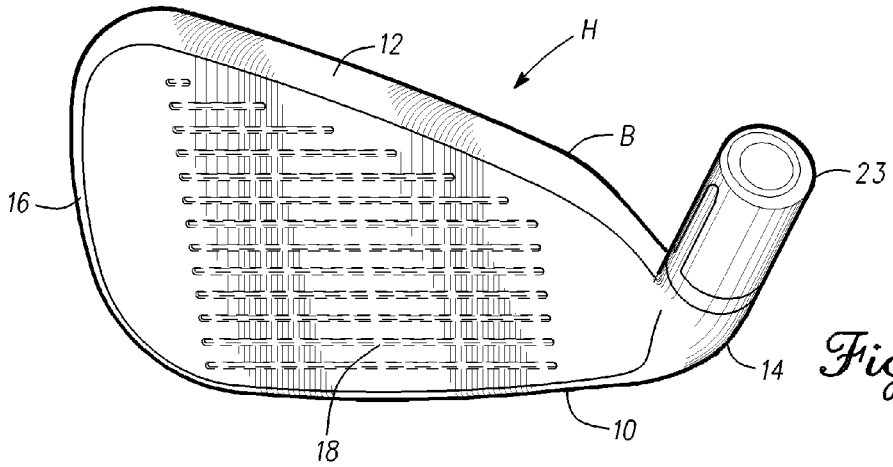
FIG. 16 is a perspective view of a golf club head incorporating another embodiment of a hosel weight according to the present invention.
Figure 17:
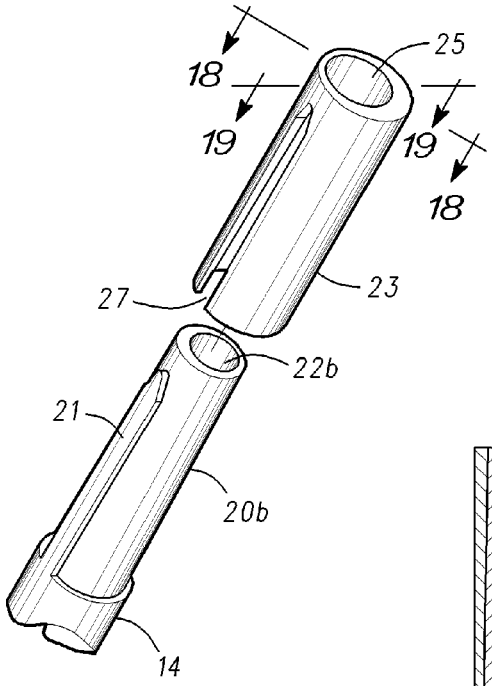
FIG. 17 is an exploded view of the heel portion of the golf club head shown in FIG. 16.

With reference to FIGS. 9-11, hosel weights 24*a*, 24*b* and 24*c* are similar to hosel weight 24 except that their bores 28*a*, 28*b* and 28*c* have different shapes than the cylindrical bore 28 in hosel weight 24. For example, the bore 28*a* in hosel weight 24*a* is rectangular and the longitudinal axis C of the hosel weight 24*a* is offset from the hosel longitudinal axis A by a distance D1. The bore 28*b* in hosel weight 24*b* is polygonal and the longitudinal axis C of the hosel weight 24*b* is offset from the hosel longitudinal axis A by a distance D2. The bore 28*c* in hosel weight 24*c* is elliptical and the longitudinal axis C of the hosel weight 24*c* is offset from the hosel longitudinal axis A by a distance D3. In the hosel weights 24*a*, 24*b* and 24*c*, the peripheral walls 30*a*, 30*b* and 30*c* that define the bores 28*a*, 28*b* and 28*c* have a thickness dimension T1 at their thickest point and a thickness dimension T2 at their thinnest point. In each of the hosel weights 24*a*, 24*b* and 24*c*, thickness dimension T1 is greater than thickness dimension T2.

It will be understood that when using the hosel weights 24*a*, 24*b* and 24*c*, the hosel 20 will be modified to have an outer shape that is complimentary to the bores 28*a*, 28*b* and 28*c*. For example, when using the hosel weight 24*a*, the hosel 20 will be modified to have a generally rectangular outer shape. When using the hosel weight 24*b*, the hosel 20 will be modified to have a generally polygonal shape and, when using the hosel weight 24*c*, the hosel 20 will be modified to have a generally elliptical outer shape.

Referring to FIGS. 12-15, the hosel weight 24 is mounted on a golf club head H having a different hosel 20*a* with a bore 22*a* that is offset (i.e. not concentric) with respect to the longitudinal axis A of the hosel 20*a*. This offset results in the peripheral wall 26*a* of the hosel 20*a* having a varying thickness dimension similar to the varying thickness dimension of the peripheral wall 30 of the hosel weight 24. The combination of the hosel 20*a* and the hosel weight 24 results in the bore 22*a* being centered (instead of offset) with respect to the outer periphery of the hosel weight 24 when the hosel weight 24 is in the position shown in FIG. 5.

Figure 18:
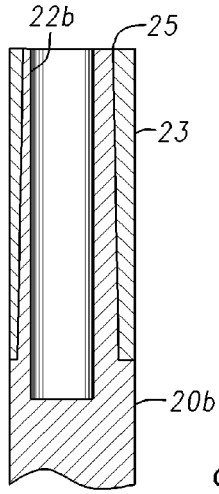
FIG. 18 is a cross sectional view taken along lines 18-18 in FIG. 17.
Figure 19:
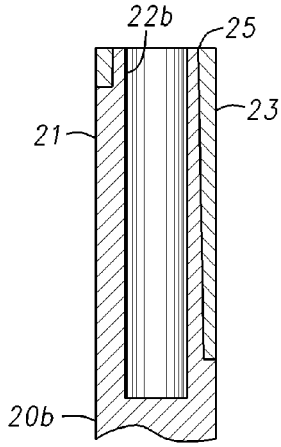
FIG. 19 is a cross sectional view taken along lines 19-19 in FIG. 17.

With reference to FIGS. 16-19, an iron-type golf club head H includes a body B with a sole 10, a top edge 12, a heel portion 14, a toe portion 16 and a front face 18 as described above. The golf club head H also includes a hosel 20*b* on the body heel portion 14 with a bore 22*b* for receiving the end of a golf club shaft (not shown). The bore 22*b* is offset (i.e. not concentric) relative to the longitudinal axis of the hosel 20*b*. An elongated lug 21 is provided on one side of the hosel 20*b*. A hosel weight 23 includes an offset bore 25 that receives the hosel 20*b*. A slot 27 extends along one side of the hosel weight 23 and receives the lug 21 in order to lock the hosel weight 23 in position on the hosel 20*b* and prevent it from rotating. As seen in FIG. 18, the hosel 20*b* is tapered from bottom to top and the bore 25 in the hosel weight 23 increases in diameter from top to bottom in order to match the taper of the hosel 20*b*.

The invention claimed is:

1. A golf club head comprising:

a body comprising:

a heel portion;

a toe portion;

a front face extended between the heel and toe portions; and a hosel proximate the heel portion;

and a hosel weight mountable around the hosel;

wherein:

the hosel comprises:

an inner hosel perimeter configured to accommodate an end of a golf club shaft;

an outer hosel perimeter bounding the inner hosel perimeter; and a hosel wall defined between the inner and outer hosel perimeters;

the hosel wall comprises:

a first hosel wall thickness between the inner and outer hosel perimeters; and a second hosel wall thickness between the inner and outer hosel perimeters and located opposite the first hosel wall thickness;

the hosel weight comprises:

an inner weight perimeter complementary with, and configured to accommodate, the outer hosel perimeter;

an outer weight perimeter bounding the inner weight perimeter; and a weight wall defined between the inner and outer weight perimeters; and a weight longitudinal axis extended from end to end of a bore of the weight;

the weight wall comprises:

a first weight wall thickness between the inner and outer weight perimeters;

a second weight wall thickness between the inner and outer weight perimeters and located opposite the first weight wall thickness; and at least a portion of the weight wall with a closed perimeter cross-sectional shape; and when the hosel weight is mounted around the hosel:

an entirety of the inner weight perimeter is configured to contact the hosel; the hosel weight is straight throughout the weight longitudinal axis from end to end of the weight; and the first and second weight wall thicknesses are different from each other and a thickness difference is along the entire length of the weight, wherein the entire hose weight inner perimeter is in contact with the hosel, wherein the hosel weight is straight end to end in the longitudinal direction when attached to the hosel, and wherein the weight has a closed cross sectional shape from end to end.

2. The golf club head of claim 1, wherein:

a single piece of the body comprises the heel portion and the hosel; and the hosel weight comprises a density greater than a density of the single piece.

3. The golf club head of claim 1, wherein:

the hosel weight extends along an entire length of the hosel when mounted around the hosel.

4. The golf club head of claim 1, wherein:

the first and second hosel wall thicknesses are different from each other.

5. The golf club head of claim 4, wherein:

the hosel comprises a hosel longitudinal axis extended from end to end of a bore of the hosel;

the outer hosel perimeter is centered about the hosel longitudinal axis;

the first hosel wall thickness is constant along a first portion of the hosel wall;

the second hosel wall thickness is constant along a second portion of the hosel wall;

and the first and second portions of hosel wall are parallel to the hosel longitudinal axis.

6. The golf club head of claim 1, wherein:

the outer weight perimeter is centered about the weight longitudinal axis;

the first weight wall thickness is constant along a first portion of the weight wall;

the second weight wall thickness is constant along a second portion of the weight wall;

and the first and second portions of weight wall are parallel to the weight longitudinal axis.

7. The golf club head of claim 6, wherein:

the bore of the weight comprises a cross-sectional area perpendicular to the weight longitudinal axis, the cross-sectional area being at least one of:

circular, rectangular, polygonal, hexagonal, ellipsoidal, or oval-shaped.

8. The golf club head of claim 1, wherein:

the first weight wall thickness comprises a thickest thickness of the weight wall; and the second weight wall thickness comprises a thinnest thickness of the weight wall.

9. The golf club head of claim 8, wherein:

the hosel weight is repositionable about the hosel to adjust an orientation of the first and second weight wall thicknesses relative to the first and second hosel wall thicknesses.

10. The golf club head of claim 8, wherein:

the first weight wall thickness is positionable to abut the second hosel wall thickness; and the second weight wall thickness is positionable to abut the first hosel wall thickness.

11. The golf club head of claim 10, wherein:

the first hosel wall thickness comprises a thickest thickness of the hosel wall; and the second hosel wall thickness comprises a thinnest thickness of the hosel wall.

12. The golf club head of claim 11, wherein:

the first hosel wall thickness faces the toe portion of the body; and the second hosel wall thickness faces the heel portion of the body.

13. The golf club head of claim 8, wherein:

the hosel wall and the weight wall are configured to comprise at least one of:

a first configuration wherein:

the first hosel wall thickness faces the toe portion of the body;

the second hosel wall thickness faces the heel portion of the body;

the first weight wall thickness faces the heel portion of the body; and the second weight wall thickness faces the toe portion of the body;

a second configuration wherein:

the first hosel wall thickness faces the heel portion of the body;

the second hosel wall thickness faces the toe portion of the body;

the first weight wall thickness faces the toe portion of the body; and the second weight wall thickness faces heel portion of the body;

a third configuration wherein:

the first hosel wall thickness faces a front portion of the body;

the second hosel wall thickness faces a rear portion of the body;

the first weight wall thickness faces the rear portion of the body; and the second weight wall thickness faces front portion of the body;

or a fourth configuration wherein:

the first hosel wall thickness faces the rear portion of the body;

the second hosel wall thickness faces the front portion of the body;

the first weight wall thickness faces the front portion of the body; and the second weight wall thickness faces rear portion of the body.

14. The golf club head of claim 1, wherein:
the body further comprises a shoulder around a bottom end of the outer hosel perimeter; and
a bottom end of the hosel weight is supported by the shoulder when the hosel weight is mounted around the hosel.

15. The golf club head of claim 1, wherein:
the body comprises at least one of:
a titanium material;
a steel material; or
a first composite material;
and
the hosel weight comprises at least one of:
a metal material; or
a second composite material.

16. The golf club head of claim 1, wherein:
the outer hosel perimeter comprises a lug thereupon; and
the inner hosel weight perimeter comprises a slot configured to receive the lug when
the hosel weight is mounted around the hosel.

17. A golf club head comprising:
a body comprising:
a heel portion;
a toe portion;
a front face extended between the heel and toe portions; and
a hosel proximate the heel portion and protruding above the front face;
and
a hosel weight mountable around the hosel;
wherein:
the hosel comprises:
an inner hosel perimeter configured to accommodate an end of a golf club shaft;
an outer hosel perimeter bounding the inner hosel perimeter; and
a hosel wall defined between the inner and outer hosel perimeters;
the hosel wall comprises:
a first hosel wall thickness between the inner and outer hosel perimeters; and
a second hosel wall thickness between the inner and outer hosel perimeters and located opposite the first hosel wall thickness;
the hosel weight comprises:
an inner weight perimeter complementary with, and configured to accommodate, the outer hosel perimeter;
an outer weight perimeter bounding the inner weight perimeter; and
a weight wall defined between the inner and outer weight perimeters;
the weight wall comprises:
a first weight wall thickness between the inner and outer weight perimeters; and
a second weight wall thickness between the inner and outer weight perimeters and located opposite the first weight wall thickness;
the first and second weight wall thicknesses are different from each other;
a single piece of the body comprises the heel portion and the hosel;
the hosel weight is denser than the single piece;
the hosel weight remains straight and extends along an entire length of the hosel when mounted around the hosel;
the hosel comprises a hosel longitudinal axis extended from end to end of a bore of the hosel;
the outer hosel perimeter is centered about the hosel longitudinal axis;
the first hosel wall thickness is constant along a first portion of the hosel wall;
the second hosel wall thickness is substantially constant along a second portion of the hosel wall;
the first and second portions of hosel wall are parallel to the hosel longitudinal axis;
the weight comprises a weight longitudinal axis extended from end to end of a bore of the weight;
the outer weight perimeter is centered about the weight longitudinal axis;
the first weight wall thickness is substantially constant along a first portion of the weight wall;
the second weight wall thickness is substantially constant along a second portion of the weight wall;
the first and second portions of weight wall are parallel to the weight longitudinal axis;
the first weight wall thickness comprises a thickest thickness of the weight wall; and
the second weight wall thickness comprises a thinnest thickness of the weight wall.

18. The golf club head of claim 17, wherein:
the first weight wall thickness is positionable to abut the second hosel wall thickness;
the second weight wall thickness is positionable to abut the first hosel wall thickness;
the first hosel wall thickness comprises a thickest thickness of the hosel wall;
the second hosel wall thickness comprises a thinnest thickness of the hosel wall;
the first hosel wall thickness faces the toe portion of the body;
the second hosel wall thickness faces the heel portion of the body;
the body further comprises a shoulder around a bottom end of the outer hosel perimeter;
a bottom end of the hosel weight is supported by the shoulder when the hosel weight is mounted around the hosel;
the body comprises at least one of:
a titanium material;
a steel material; or
a first composite material;
the hosel weight comprises at least one of:
a metal material; or
a second composite material;
and
the bore of the weight comprises a cross-sectional area perpendicular to the weight longitudinal axis, the cross-sectional area being at least one of circular, rectangular, polygonal, hexagonal, ellipsoidal, or oval-shaped.

* * * * *